US011511299B2

(12) United States Patent
Moretti

(10) Patent No.: US 11,511,299 B2
(45) Date of Patent: Nov. 29, 2022

(54) TOTTLE WITH DISPENSING SYSTEM

(71) Applicant: LUMSON S.p.A., Capergnanica (IT)

(72) Inventor: Matteo Moretti, Crema (IT)

(73) Assignee: LUMSON S.p.A., Capergnanica (IT)

( * ) Notice: Subject to any disclaimer, the term of this patent is extended or adjusted under 35 U.S.C. 154(b) by 191 days.

(21) Appl. No.: 16/909,125

(22) Filed: Jun. 23, 2020

(65) Prior Publication Data

US 2020/0406279 A1 Dec. 31, 2020

(30) Foreign Application Priority Data

Jun. 26, 2019 (IT) ..... 102019000010161

(51) Int. Cl.
*B05B 11/00* (2006.01)
*A45D 40/00* (2006.01)
*A47K 5/12* (2006.01)

(52) U.S. Cl.
CPC ..... *B05B 11/3047* (2013.01); *A45D 40/00* (2013.01); *A47K 5/1205* (2013.01); *B05B 11/3001* (2013.01); *A45D 2200/054* (2013.01)

(58) Field of Classification Search
CPC ..... B05B 11/3047; B05B 11/3001; A47K 5/1205
See application file for complete search history.

(56) References Cited

U.S. PATENT DOCUMENTS 5,505,338 A 4/1996 Gueret
D833,878 S 11/2018 Langdon et al.
2004/0159681 A1* 8/2004 Crosnier ..... B05B 11/3074 222/321.7
2015/0144663 A1* 5/2015 Noel ..... A45D 34/00 222/383.1
2019/0060929 A1* 2/2019 Delmon ..... B05B 11/0038
2020/0406280 A1* 12/2020 Jouan ..... B05B 11/3047

FOREIGN PATENT DOCUMENTS

EP 2308604 A1 4/2011
EP 3431189 A1 1/2019
FR 2853633 A1 10/2004
JP 2008007160 A 1/2008

OTHER PUBLICATIONS

Machine Translation of FR 2853633.*
Machine Translation of EP 2308604.*
Search Report and Written Opinion dated Mar. 4, 2020 for Italian patent application No. 102019000010161.

* cited by examiner

*Primary Examiner* — Jeremy Carroll
(74) *Attorney, Agent, or Firm* — Vorys, Sater, Seymour and Pease LLP

(57) ABSTRACT

Tottle for containing and dispensing fluid, including a container endowed with first sealed end and second end featuring a neck, hermetic pump whose body is at least partially housed inside the neck, the pump coupled with the neck of the container by a collar, the pump coupled to a gasket, made as a single piece and including a first lip positioned in contact, in a sealed manner, with the pump body and shaped to fit onto the pump body by interference, and a second lip from which a sealing flange extends, and an intermediate portion which interconnects the first and second lips to form an annular groove facing a flange on the pump, so when the collar is fastened to the neck of the container, the sealing flange on the gasket is between the flange on the pump and a free edge of the container neck.

14 Claims, 2 Drawing Sheets

TOTTLE WITH DISPENSING SYSTEM

CROSS REFERENCE TO RELATED APPLICATION

This claims the benefit of Italian patent application no. 102019000010161, filed Jun. 26, 2019, hereby incorporated by reference in its entirety.

FIELD OF THE INVENTION

The present invention relates to a tottle or tube made of deformable plastic.

In particular, it relates to a tottle equipped with a pump for dispensing a fluid.

BACKGROUND ART

Members of the cosmetics packaging industry are always on the look out for new concepts for containers, as well as new ways of using and new dispensing methods for commonly known containers.

In recent years, the industry has been trying extend the use of 'tottles' (a term coined by combining 'tube' and 'bottle') to top-end products, in which the fluids contained in the container must be dispensed in a sophisticated manner.

Nevertheless, the use of conventional tottles, which usually feature flip-top or screw-on lids, have not been well accepted in such a high-end segment.

SUMMARY OF THE INVENTION

The object of the present invention is to provide an innovative dispensing system to apply to tottles.

This and other objects are achieved by means of a tottle according to the technical teachings of the claims appended hereto.

BRIEF DESCRIPTION OF THE FIGURES

Further characteristics and advantages of the invention will become apparent in the description of a preferred but not exclusive embodiment of the device, illustrated—by way of a non-limiting example—in the drawings annexed hereto, in which.

DETAILED DESCRIPTION OF THE INVENTION

Figure 1:
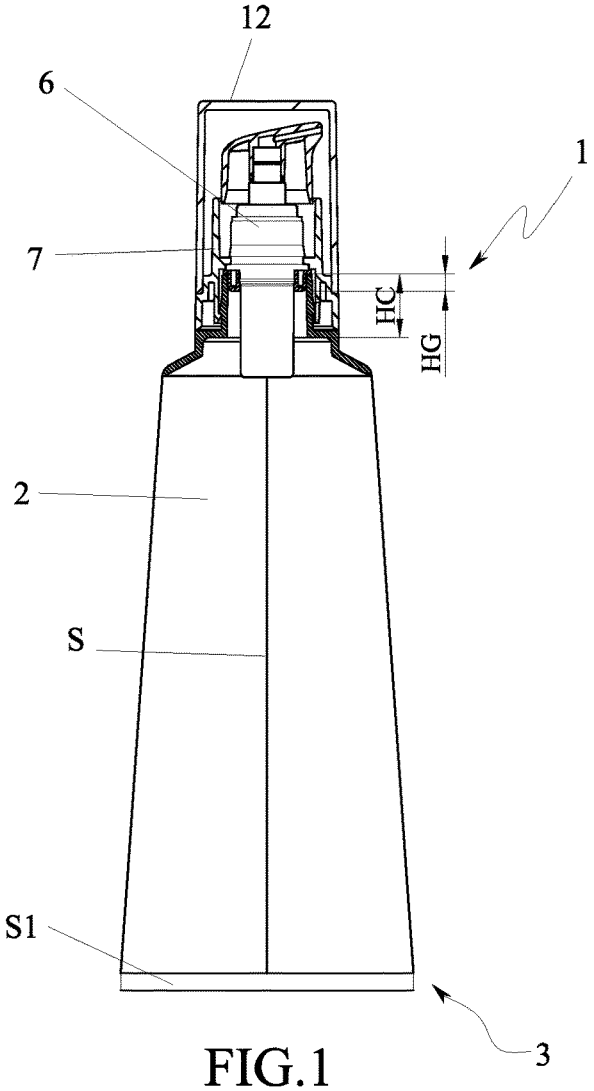
FIG. 1 is a partially sectioned view of a tottle according to the present invention.

With reference to the figures stated, reference number 1 is used to denote, as a whole, a tottle.

The tottle 1 is designed to contain and dispense a fluid.

In the present text, 'fluid' means a cosmetic or medical substance, a cream for the face or body, a cream or product to combat wrinkles, a make-up product, such as a foundation, a make-up remover, and suchlike.

The tottle comprises a container 2 equipped with a first sealed end 3 and a second end 4 featuring a neck 5.

The container 2 can be produced using a plastic mould to fashion the neck 5 thereof and a tubular side surface which is open at the base (i.e. the side opposite the neck 5), which is then compressed and welded at free end S1 (or sealed in another way) to create the sealed base 3 of the container 2 to be devoid of a resting surface at its free end S1.

The container 2 can also be formed of a simple blow-moulded bottle tapered at is free end, produced using extrusion/blow-moulded technology (still made of plastic) or with injection blow-moulding technology, using a pre-mould, but with a form which is devoid of a resting surface at its free end (i.e. the end opposed to the one where the pump is located).

In all the embodiments described above, in practice, the tottle can be placed resting on a flat surface only with the sealed end 3 thereof facing upwards (by means of a lid to be applied to the pump), or lying on a side surface.

From the drawings it can be seen that the tottle comprises a pump 6 which renders the dispensing type extremely effective and 'high-end'. The pump must be of the hermetical kind and therefore, after each dispensing action, the container deforms, ending up completely flat when the substance dispensed is finished.

The pump 6, which may be coupled to a dispensing cap 30, features a pump body 6A (FIG. 4) which is at least partially housed within the inside of the neck 5 of the container 2.

From the pump body 6A, integral with it, a flange 10 extends.

The pump is associated (or better permanently fastened) to the neck 5 of the container by means of a collar 7 which is snap-fitted onto the neck 5.

The snap-lock system is designed so that a user, during normal use of the tottle, cannot separate the collar and the container, at least not without damaging either one or the other.

Figure 4:
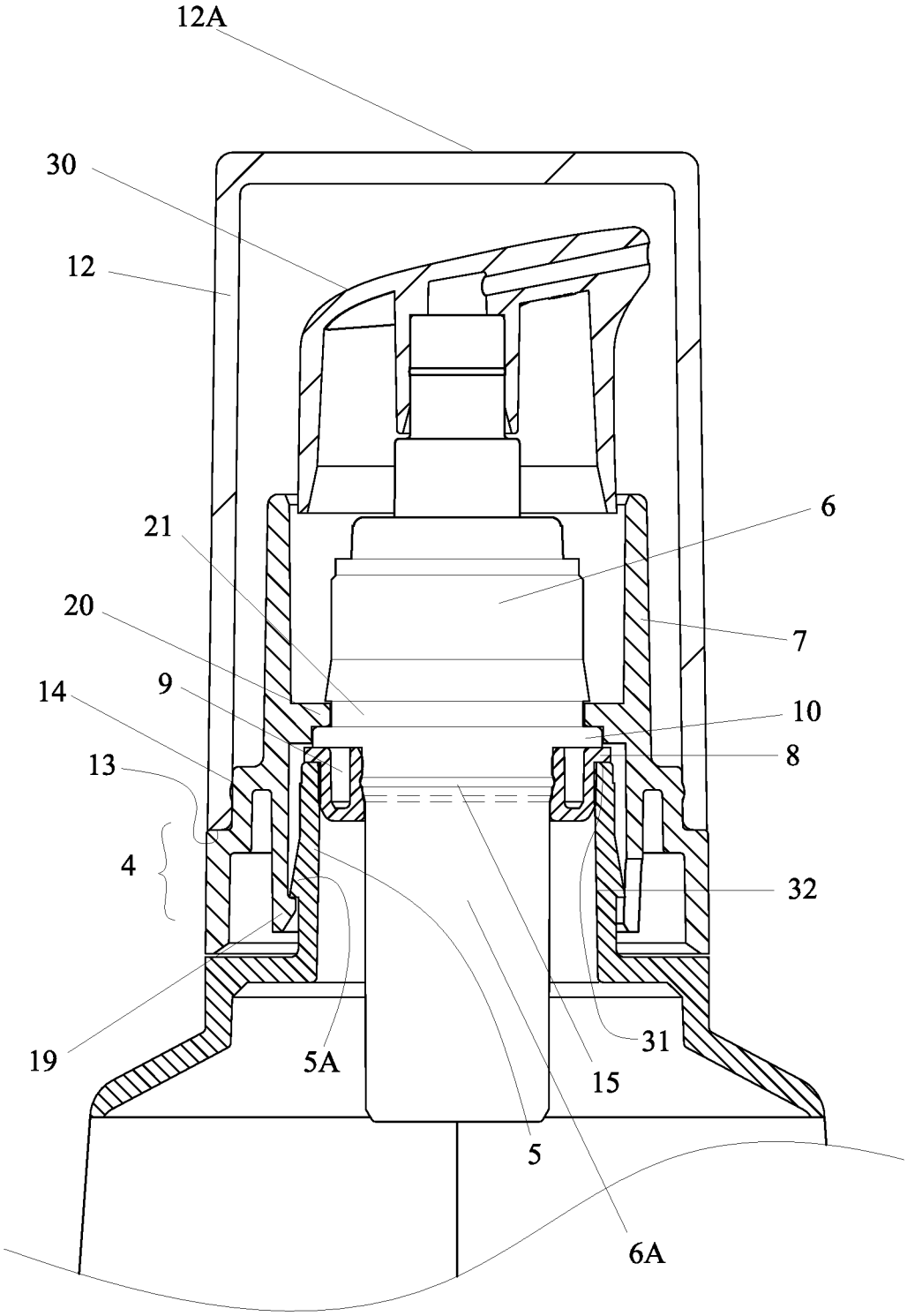
FIG. 4 is an enlargement of a part in FIG. 1.

FIG. 4 shows a detailed view of a possible means of snap-fit coupling the collar and the neck. More specifically, an outer surface of the neck 5 can feature a protruding step element 5A (which, advantageously, extends around the entire circumference of the neck 5) which cooperates, by snap-fit, with at least one tooth 19 (but preferably with more than one) on the collar 7.

The pump 6 is associated with a gasket 8 made as a single piece.

Figure 3:
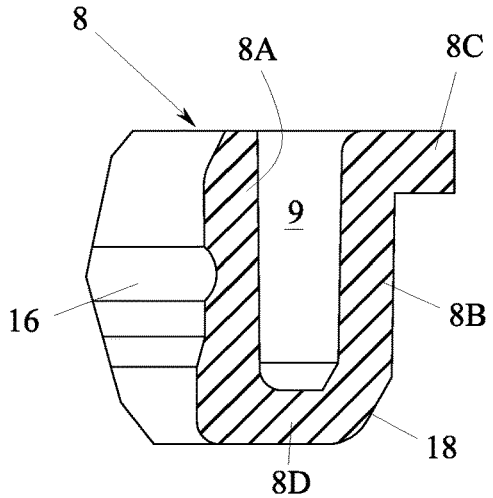
FIG. 3 is an enlarged view of the part circled in FIG. 2.
Figure 2:
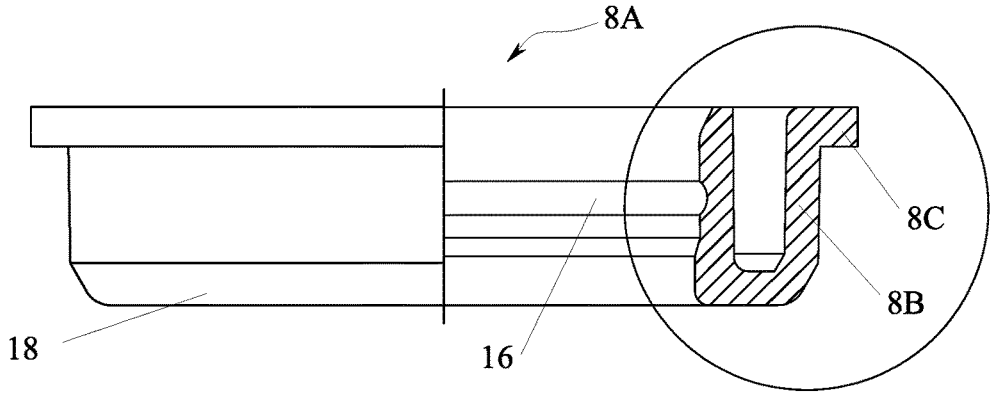
FIG. 2 is a partially sectioned view of an enlarged detail of the tottle in FIG. 1.

The material which may be used to make the gasket may be chosen from: LDPE-PE-HDPE-TPU-TPE-NITRYL-SILICONE-PP-BUTYL-NATURAL RUBBER The gasket 8 is better illustrated in FIGS. 2 and 3. It comprises a first lip 8A positioned touching the body 6A of the pump and shaped so as to fit onto the pump body 6A by means of interference (see FIG. 4).

There is also a second lip 8B present, from which a sealing flange 8C extends, and an intermediate flange 8D which interconnects the first and second lip so as to form an annular groove 9 facing a flange 10 on the pump 6.

The height of the second lip 8B may be similar or equal to the height of the first lip 8A, counted for the intermediate flange 8D.

The second lip 8B (and possibly also the first lip 8A) may have a height HG (measured from the striking surface between the flange 8C and the free edge 31 of the neck) which is less (or even equal to) the height HC of the neck.

The height HG is equal or less than half the height HC of the collar. This maximizes the volume of the product that may be filled in the container.

It is also possible that the height HG is greater or similar to the height of the neck HC.

The nearer the height HG is to the height HC (or if it is greater), the less product remains inside the container 2 at the end of dispensing, i.e. when the container 2 is completely flattened in on itself.

In this way, when the collar 7 is fastened onto the neck 5 of the container 2, the sealing flange 8C of the gasket 8 is sandwiched between the flange 10 integral to the pump body 6A and a free edge 31 of the neck 5 of the container 2.

Advantageously the pump 6 is snap-fitted onto collar 7. For example, the collar 7 may feature a fastening protrusion 20 which snap-fits into a groove 21 featured on the pump body 6A near the flange 10.

The configuration described above proves particularly advantageous during the automatic assembly of the tottle.

In practice, one way of assembling may comprise the following steps:

a. fitting the gasket 8 onto the pump body b. snap-fitting the pump 6 onto the collar 7 c. snap-fitting the collar 7 onto the neck 5 of the container.

As it may easily be imagined, a gasket like that described proves particularly effective due to the installation of a pump on the tottle.

It is worth noting that the free edge of a tottle is usually extremely narrow, and it would be essentially impossible to use a conventional gasket for coupling the pump in a sealed manner. In practice, if the gasket is not pre-fitted onto the pump in a permanent manner, it may move during assembly, creating a faulty tottle, which must be discarded.

To facilitate the premounting (but also to provide an optional seal between the gasket and the pump), the pump 6A may feature a rim 15 which engages with a seat 16 featured on the first lip 8A of the gasket 8. In this way, the coupling between the gasket and the pump is even more permanent.

The gasket 8, at a zone which interconnects the second lip 8B and the intermediate portion 8D, comprises a chamfer 18 which facilitates the insertion of the gasket 8 in the neck 5 when the gasket is coupled with the pump.

In practice, the gasket may provide three sealing zones corresponding to the first lip 8A, which forms a seal with the pump body, the second lip 8B, which forms a seal with the inner surface 32 of the neck 5 of the container, and the gasket 8C, which forms a seal with the free surface 31 of the neck 5.

Continuing with the description, it should be noted that the collar 7 features a portion 14 for coupling with a cap 12 which covers the pump and comes into contact with a step 13 on the collar 7.

The cap 12 proves to be particularly important since, as already mentioned, the tottle is positioned 'overturned' and therefore the latter may feature a flat surface 12A which can provide a stable resting surface for the entire tottle 1.

To end, it should be noted that the neck 5 may have a circular cross-section. The collar and the cap may also have a circular cross-section.

Various embodiments of the innovation have been disclosed herein, but further embodiments may also be conceived using the same innovative concept.

The invention claimed is:

1. A tottle for containing and dispensing a fluid substance, comprising a container provided with a first closed end and a second end where a neck is provided, a hermetic pump whose pump body is at least partially housed inside the neck, the pump being associated with the neck of the container via a collar, the pump comprising a flange integrally formed with the pump body, the pump being associated to a sealing gasket made in a single piece, which comprises a first lip positioned in contact and sealed with the body of the pump and shaped so as to fit with interference on the pump body, and a second lip from which extends a sealing flange and an intermediate portion which interconnects the first and second lips to form an annular groove facing the flange of the pump, so that when the collar is fixed to the neck of the container the sealing flange of the gasket is sandwiched between the flange of the pump and a free edge of the neck of the container, wherein the container first end is devoid of a surface for resting on a flat surface.

2. The tottle according to claim 1, in which the pump is snap-fixed to the collar and/or in which the collar is snap-fitted to the neck.

3. The tottle according to claim 1, wherein the neck has a circular section.

4. The tottle according to claim 1, wherein the collar provides a portion for coupling to a cap which covers the pump and stops on a step of the collar.

5. The tottle according to claim 1, wherein the body of the pump provides a rim which engages in a seat provided on the first lip of the gasket.

6. The tottle according to claim 1, wherein the gasket at a zone which interconnects the second lip and the intermediate portion comprises a chamfer which facilitates the insertion of the gasket in the neck.

7. The tottle according to claim 1, wherein the second lip of the gasket is sealedly coupled with the inner surface of the neck of the container.

8. The tottle according to claim 1, wherein an outer surface of the neck provides a protruding step element which cooperates with at least one tooth of the collar for snap-fitting the collar with the neck.

9. The tottle according to claim 1, wherein the collar has a fastening protrusion which snaps into a groove provided on the pump body near the flange.

10. The method of assembling a tottle according to claim 1, which comprises the steps of:

a. fit the gasket on the pump body b. snap the pump onto the collar c. snap the collar onto the neck of the container.

11. The tottle according to claim 1, wherein the tottle is a fluid dispensing apparatus wherein the container first end is tapered to be devoid of the surface for resting on the flat surface.

12. The tottle of claim 11, wherein the tottle is placeable to rest on the flat surface only with the container first end facing up or lying on a side surface.

13. The tottle of claim 12, wherein the tottle further comprising a cap which covers the pump to provide a resting surface for resting said toggle on the flat surface.

14. The tottle of claim 13, wherein the collar provides a portion for coupling to the cap which covers the pump and stops on a step of the collar.

* * * * *